US006058818A

United States Patent [19]

Dieterlen

[11] Patent Number: 6,058,818

[45] Date of Patent: May 9, 2000

[54] CONVERTIBLE PITCH KNIFE APPARATUS

[75] Inventor: Paul E. Dieterlen, Covington, Ky.

[73] Assignee: R.A. Jones & Co. Inc., Covington, Ky.

[21] Appl. No.: 09/024,553

[22] Filed: Feb. 17, 1998

Related U.S. Application Data

[63] Continuation of application No. 08/338,848, Nov. 14, 1994, abandoned.

[51] Int. Cl.[7] ..... B26D 1/62; B26D 5/20; B26D 7/06

[52] U.S. Cl. ..... 83/152; 83/99; 83/100; 83/323; 83/345; 83/482; 83/698.61; 83/945; 53/562

[58] Field of Search ..... 83/100, 152, 322, 83/323, 343, 344, 345, 492, 503, 507, 506, 157, 99, 859, 482, 495, 496, 497, 591, 659, 673, 674, 675, 945, 698.61, 699.61; 493/471, 371, 365, 367, 197, 196, 195, 194; 53/451, 455, 558, 562; 494/53, 101, 136

[56] References Cited

U.S. PATENT DOCUMENTS

| | | | |
|---|---|---|---|
| 85,012 | 12/1868 | King | 474/136 |
| 1,570,591 | 1/1926 | Mercer | 474/136 |
| 3,224,311 | 12/1965 | Wagner | 83/345 |
| 3,597,898 | 8/1971 | Cloud | 53/183 |
| 3,683,729 | 8/1972 | Cloud | 83/345 |
| 3,703,841 | 11/1972 | Crawford | 83/345 |
| 3,709,077 | 1/1973 | Trogan et al. | 83/345 |
| 3,757,620 | 9/1973 | Cloud | 83/345 |
| 3,890,866 | 6/1975 | Verjux | 83/343 |
| 4,061,063 | 12/1977 | Brush | 83/345 |
| 4,216,690 | 8/1980 | Bullock | 83/345 |
| 4,334,449 | 6/1982 | Hinz et al. | 83/345 |
| 4,507,037 | 3/1985 | Fenimore | 83/503 |
| 4,872,382 | 10/1989 | Benner, Jr. et al. | 83/152 |
| 5,144,874 | 9/1992 | Garrett | 83/345 |
| 5,156,076 | 10/1992 | Rosemann | 83/659 |
| 5,222,422 | 6/1993 | Benner, Jr. et al. | 83/37 |
| 5,502,951 | 4/1996 | Oliverio et al. | 53/455 |
| 5,575,187 | 11/1996 | Dieterlen | 83/98 |
| 5,829,332 | 11/1998 | Dieterlen | 83/98 X |

FOREIGN PATENT DOCUMENTS

| | | | |
|---|---|---|---|
| 212173 | 7/1909 | Germany | 83/344 |

*Primary Examiner*—M. Rachuba
*Assistant Examiner*—Boyer Ashley
*Attorney, Agent, or Firm*—Wood, Herron & Evans, L.L.P.

[57] ABSTRACT

Rotary knife apparatus used in connection with a pouch form, fill and seal machine capable of handling a substantially wide range of pouch sizes or variations in pouch fills. The apparatus includes major and minor knife hubs cantilevered on respective shafts and driven by a continuous backwrapped chain or timing belt. Rigid knife blades are mounted to interchangeable knife blocks on the major knife hub having varying radial dimensions to accommodate varying pouch chordal distances. The minor knife hub is laterally adjustable relative to the major knife hub along a fixed path to accommodate the substantial changeover.

9 Claims, 6 Drawing Sheets

CONVERTIBLE PITCH KNIFE APPARATUS

This application is a continuation of application Ser. No. 08/338,848, filed on Nov. 14, 1994, now abandoned, which is incorporated herein by reference in its entirety.

BACKGROUND OF THE INVENTION

This invention relates to pouch machines and, more particularly, to an improved rotary knife apparatus used in connection with a pouch form, fill and seal machine capable of handling a wide range of pouch sizes.

The present application is related to the following United States patent applications filed on even date herewith and entitled: "Variable Count Direct Deposit Knife", by P. Dieterlen, Ser. No. 08/338,840, now U.S. Pat. No. 5,515,787; "Low Thermal Inertia Sealer", by M. Wildmoser, Ser. No. 08/338,470, now U.S. Pat. No. 5,502,952; "Convertible Pitch Pouch Machine", by F. Oliverio and B. Makutonin, Ser. No. 08/338,860, now U.S. Pat. No. 5,502,951, and "Tuck Roller with Improved Web Tension Control" by Martin Wildmoser and Frank G. Oliverio, Serial No. 08/338,839, now U.S. Pat. No. 5,611,194 each of which is expressly incorporated herein by reference.

In pouch machines of the known art, such as disclosed in U.S. Pat. No. 3,597,898 which is herewith incorporated herein by reference, a flat web of heat sealable material is continuously fed from upstream of the pouch machine to be longitudinally folded upon itself by a plow or similar device. In this form, the thus-folded web is fed about a sealer which contacts the folded web along vertical heated land areas to form transverse vertical seals and, thus, a series of open pouches along the web. In this way, the web of open pouches is passed around a filler wheel, filled with product and then sealed along the top edge of the web. The web of filled pouches then passes downstream to a motor-driven rotary knife apparatus which cuts the web along the transverse vertical seals into separate individual pouches for subsequent cartoning or other secondary packaging.

It is not unusual for a product manufacturer to run different types of products on a pouch machine. In one situation, the same pre-fill pouch size may be used but one type product might lightly fill the pouch while another type of product might bulge the pouch considerably. In another situation, a different pre-fill pouch size pouch may be required for a different type of product. As these pouches are filled, a chord is defined extending between the vertical seal centerlines on each side of the pouch. In the former case, the chordal distance between the vertical seals will change as a full pouch will define a shorter chord than a lightly filled pouch of the same pre-fill size. In the latter case, the chordal change may be substantial.

In a typical rotary knife apparatus of the known art, a plurality of rigid knife blades extend radially from a major knife hub and another plurality of flexible blades extend radially from a minor knife hub in such a fashion to cooperate in shear with the rigid knife blades. The major and minor knife hubs are supported on respective shafts mounted in a frame. The frame includes a pair of spaced parallel metal plates having bearings attached thereto to support the major and minor knife hub shafts. The shafts include respective driving and driven gears which intermesh so that the rigid and flexible blades come together and shear across the web along the vertical seals to cut off the individual pouches from the web.

In such a rotary knife apparatus, the outer edges of the rigid knife blades extending from the major knife hub lie in a circle. The knife blades are spaced circumferentially about the knife hub such that each knife blade outer edge is equidistant from the other adjacent knife blade edges, this distance usually matching the chordal distance between the vertical seals of the filled pouches so the pouches are cut along the centerlines of the seals. The chordal distance between the rigid knife blade edges must substantially match the chordal distance between the filled pouches to avoid cutting open the filled pouches, that is, cutting beyond the seals.

Adjustments can be made to the radial positions of the rigid knife blades to compensate for slight changes in the chordal distance of the pouches due, for example, to different pouch fills or the like. As the radial position of the rigid knife blade edges is changed from a larger circle to a smaller circle, the chordal distance between adjacent knife blades is changed. This adjustment accommodates smaller chordal distances between the pouches. In a similar fashion, the rigid knife blade edges can be extended radially outwardly to accommodate somewhat larger pouch widths.

Thus, in this regard, before the present invention was made, an advance was provided for facilitating slight radial adjustment of the rigid knife blade edges as disclosed in U.S. Pat. No. 4,872,382 for fine tuning. This was accomplished by the use of a cone having a conical surface and disposed in the center of the cage supporting an inner edge of each knife. The cone is threaded to a screw so that upon rotation of the screw the cone moves axially with respect to the cage. When the cone moves axially, the knife blades, mounted on the conical surface, move radially in and out. Thus, with a simple but precise turning of the screw, a very precise and simultaneous change of the radial locations of all knife blades can be made to fine tune the cutting operation.

A further advance was disclosed in U.S. Pat. No. 5,222,422, which is herewith incorporated herein by reference, wherein the radial position of the rigid knife blade edges is fixed while radially extending and selectively positionable pouch guides are provided to project beyond or retract to the knife blade edges. These guides can be extended or retracted in relation to the knife blades to accommodate changes in pouch chordal distances within a relatively narrow range without having to change the knife blade positions.

While these advances have proven useful, the range of radial adjustment of the knife blades does not accommodate as wide a variation in the pouch sizes or fills as is desired in current pouch form, fill and seal operations. Greater variations of knife blade chordal distances, beyond the limits provided by the known radially adjustable knife blades or pouch guides, typically require the rotary knife apparatus to be returned to the vendor for changing sizes of the major and minor knife hubs. This changeover is typically not feasible in the field due to the complexity in design of the frame support and intermeshing gears. As the major and minor knife hubs are changed, thereby changing their respective diameters, the shaft centers of the major and minor knife hub shafts, and, thus, their respective gears, must be correspondingly changed to accommodate the changeover. Due to this complexity, the changeover can be cost and time prohibitive to a user, thereby resulting in a rotary knife apparatus which is dedicated to a relatively small range of pouch chordal distances.

Accordingly, an objective of this invention has been to provide a rotary knife apparatus which will accommodate a substantially wider range of pouch sizes or variations in pouch fills than can be accommodated by present adjustable knife apparatus having radially adjustable knife blades or pouch guides while at the same time reducing labor and materials costs for the changeover.

SUMMARY OF THE INVENTION

The objective of this invention has been attained by providing rotary knife apparatus having a major knife hub which includes a plurality of knife blocks radially extending from and mounted on the major knife hub. The knife blocks include rigid knife blades mounted on an upper edge thereof for cooperating in shear with flexible knife blades of a minor knife hub. Substantial changeovers to different chordal distances between adjacent rigid knife blade edges are accomplished by changing the knife blocks with knife blocks having greater or lesser radial lengths. As the knife blocks are changed, thereby changing the diameter of the major knife hub, the minor knife hub is laterally or radially adjustable relative to the major knife hub axis to maintain the shearing relationship.

In a preferred embodiment of this invention, the major and minor knife hubs are supported by independent cantilevered shafts to provide easy access to the knife blocks during a substantial changeover. The shafts have respective free ends which are unobstructed during the changeover whereby the major and minor knife hubs can be slidably removed from the shafts as required. In this way, the knife blocks can be accessed and changed or the knife hubs replaced with different pitch knife hubs to accommodate the changed pouch chordal distance.

During a substantial changeover, the minor knife shaft is laterally movable relative to the major knife shaft along a fixed path and fixedly positionable to accommodate for the increased or decreased radial dimensions of the knife blocks. The major and minor shafts are preferably driven by a continuous flexible driving belt or chain to accommodate movement of the minor knife shaft relative to the major knife shaft during a substantial changeover. In this way, the major and minor knife hub shafts are driven without having to maintain proper intermeshing of gears as practiced in the prior art.

In one form of the invention, it is preferred to have a plurality of radially extending pouch guides mounted adjacent the knife blocks and the rigid knife blades and further being selectively extensible and retractable in respective radial dimensions independently of the knife blocks and the knife blades to accommodate varying pouch fills and changeovers to different pitch knife diameters. The pouch guides are adjustable via an adjustable cone mechanism within the major knife hub to accommodate changes in pouch chordal distances within a relatively narrow range without having to change the knife blocks.

It is further preferred that the major knife hub include a plurality of radially extending suction cups mounted between the knife blocks and further being selectively extensible and retractable in respective radial dimensions independently of the knife blocks and the rigid knife blades via the adjustable cone so that as the pouch guides are adjusted, the radial position of the suction cups will be adjusted accordingly.

In accordance with the present invention, as the knife blocks on the major knife hub are changed, thereby changing the major knife hub's pitch, that is, the chordal distance between adjacent rigid knife blades, the minor knife blades must also be adjusted to maintain the proper shearing relationship. In one embodiment, this can be accomplished by replacing the minor knife hub with a suitable minor knife hub, and laterally adjusting the shaft centers of the major and minor knife hub shafts accordingly. This embodiment is preferred due to the simplicity in manufacture of the minor knife hub. It is recognized, however, that the minor knife blades can be similarly mounted on interchangeable knife blocks as the rigid knife blades of the major knife hub.

It will be appreciated that when the knife blocks are changed according to this invention, the rotary knife apparatus is able to accommodate a substantially wider range of pouch chord changes due to variations in pre-fill pouch sizes or pouch fills than can be accommodated by prior adjustable rotary knife apparatus. Stated in another way, the invention accommodates major pouch chord changes while still maintaining within each change range the fine tuning capability of prior knives.

BRIEF DESCRIPTION OF THE DRAWINGS

These and other modifications and advantages will become even more readily apparent from the following detailed description of a preferred embodiment of the invention, and from the drawings in which.

DETAILED DESCRIPTION OF THE INVENTION

Figure 1:
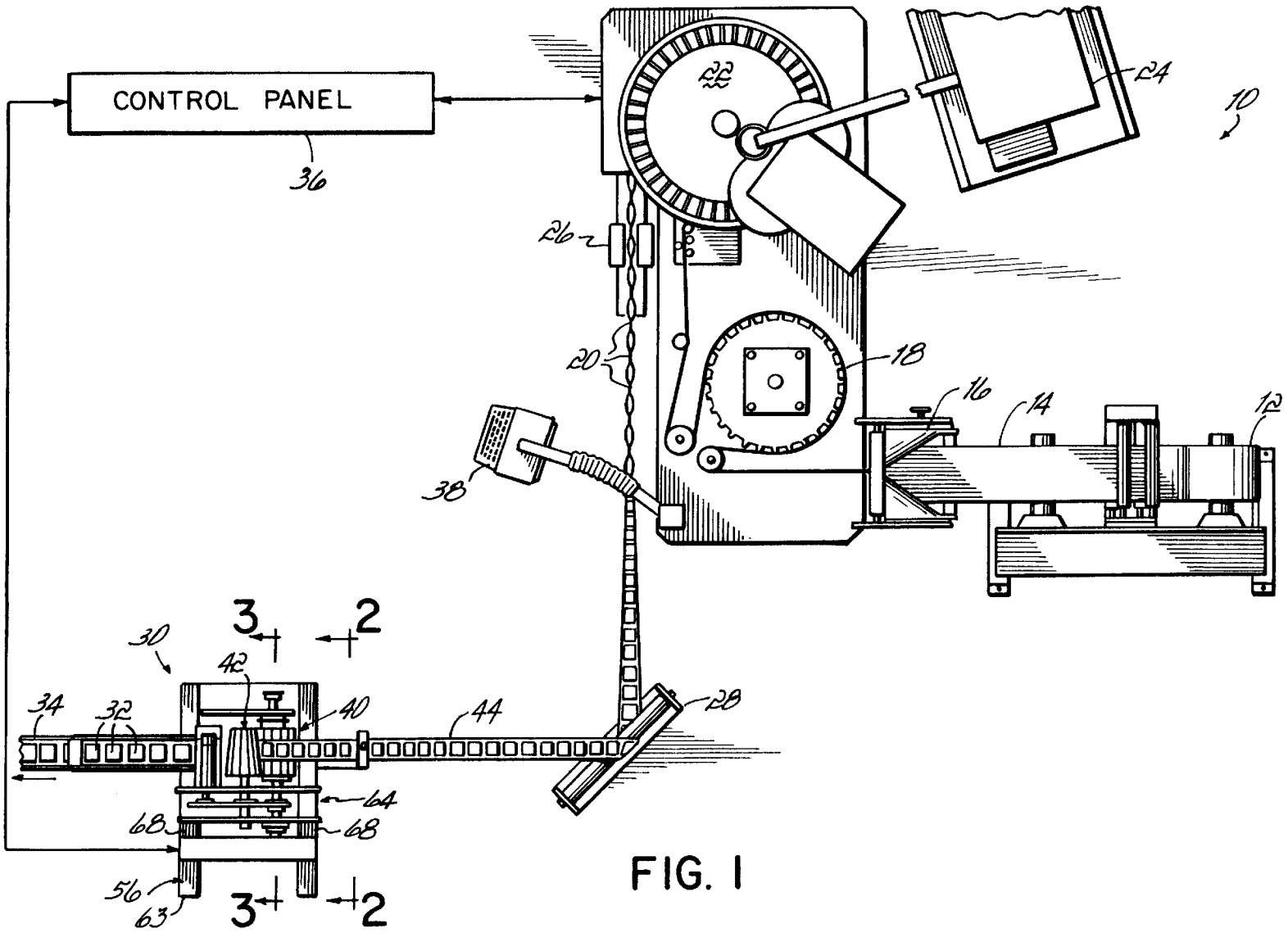
FIG. 1 is a diagrammatic plan view of a pouch form, fill and seal machine in which the present invention is used.

With reference to FIG. 1, a pouch form, fill and seal machine 10 is shown having a web supply 12 feeding a flat web 14 of heat-sealable material through plow 16 to be longitudinally folded upon itself. The thus-folded web is passed about a vertical sealer 18 having vertically extending heated sealing surfaces which contact the folded web along discrete areas to form transverse seals 20. In this way, open-ended pouches are formed along the web between the transverse seals 20 and are passed around a filler wheel 22 to be filled with product fed from a product feeding station 24. The train of filled open-ended pouches then passes through an upper edge sealer 26 which seals the pouches along respective open ends between the transverse seals 20.

In one embodiment, the web of filled and sealed pouches is rotated 90 degrees through turning bar 28 and passed through a rotary knife apparatus 30 wherein the web of pouches is cut along the transverse seals 20 into individual pouches 32. Preferably, the individual pouches 32 are dropped onto a product transfer conveyor 34 disposed beneath the rotary knife apparatus 30 for subsequent cartoning or other secondary packaging. Operation of the pouch form, fill and seal machine 10 and the rotary knife apparatus 30 is controlled via a control panel 36 which receives user commands via an operator control console 38 and which further receives and generates appropriate control signals for operation of the machine 10 and the rotary knife apparatus 30 as will be described in more detail below. It will be appreciated that the control panel 36 includes controllers understood by those skilled in the art for operation of the pouch form, fill and seal machine 10.

Figure 2:
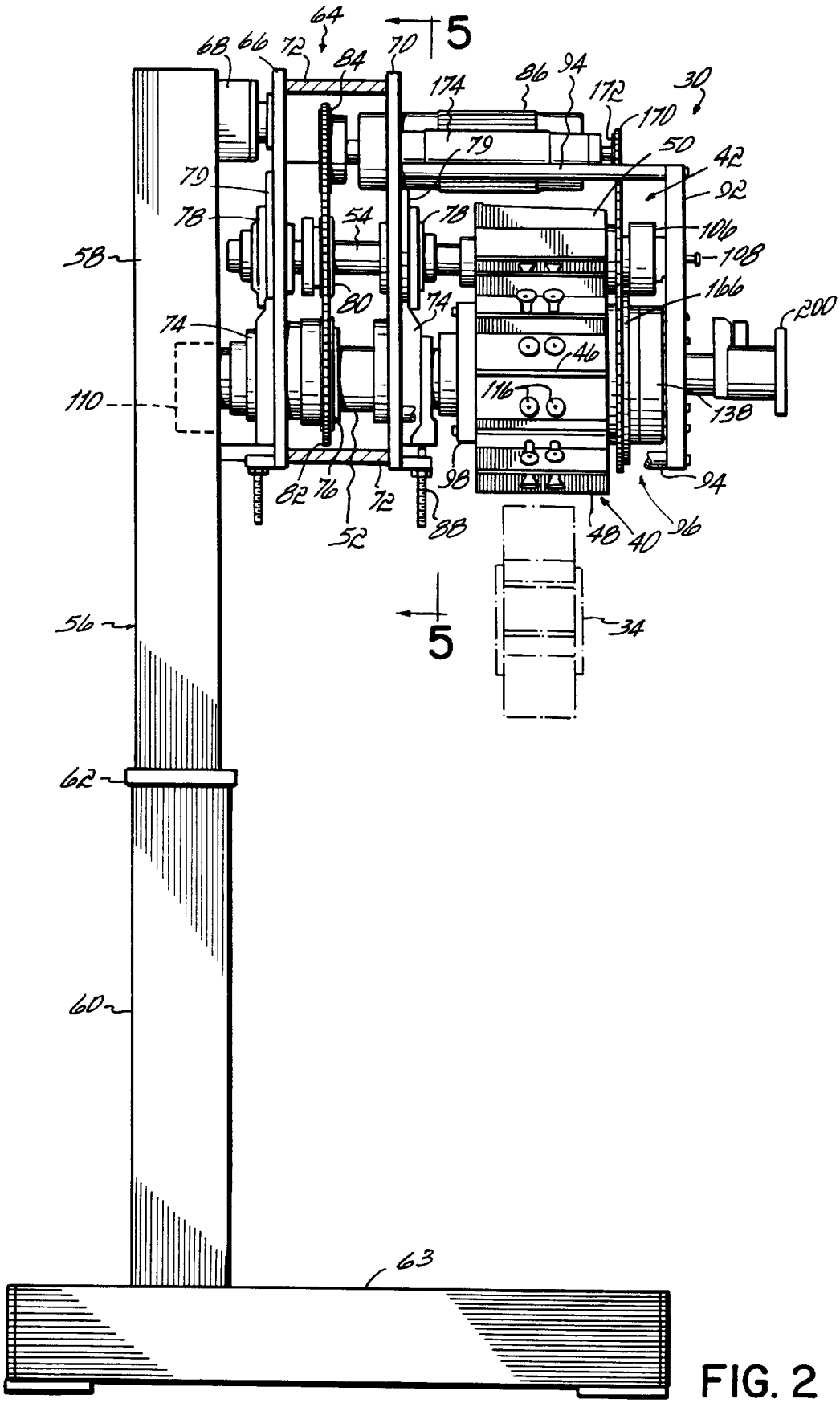
FIG. 2 is a cross-sectional view of the present invention taken along lines 2—2 of FIG. 1.
Figures 3, 3A:
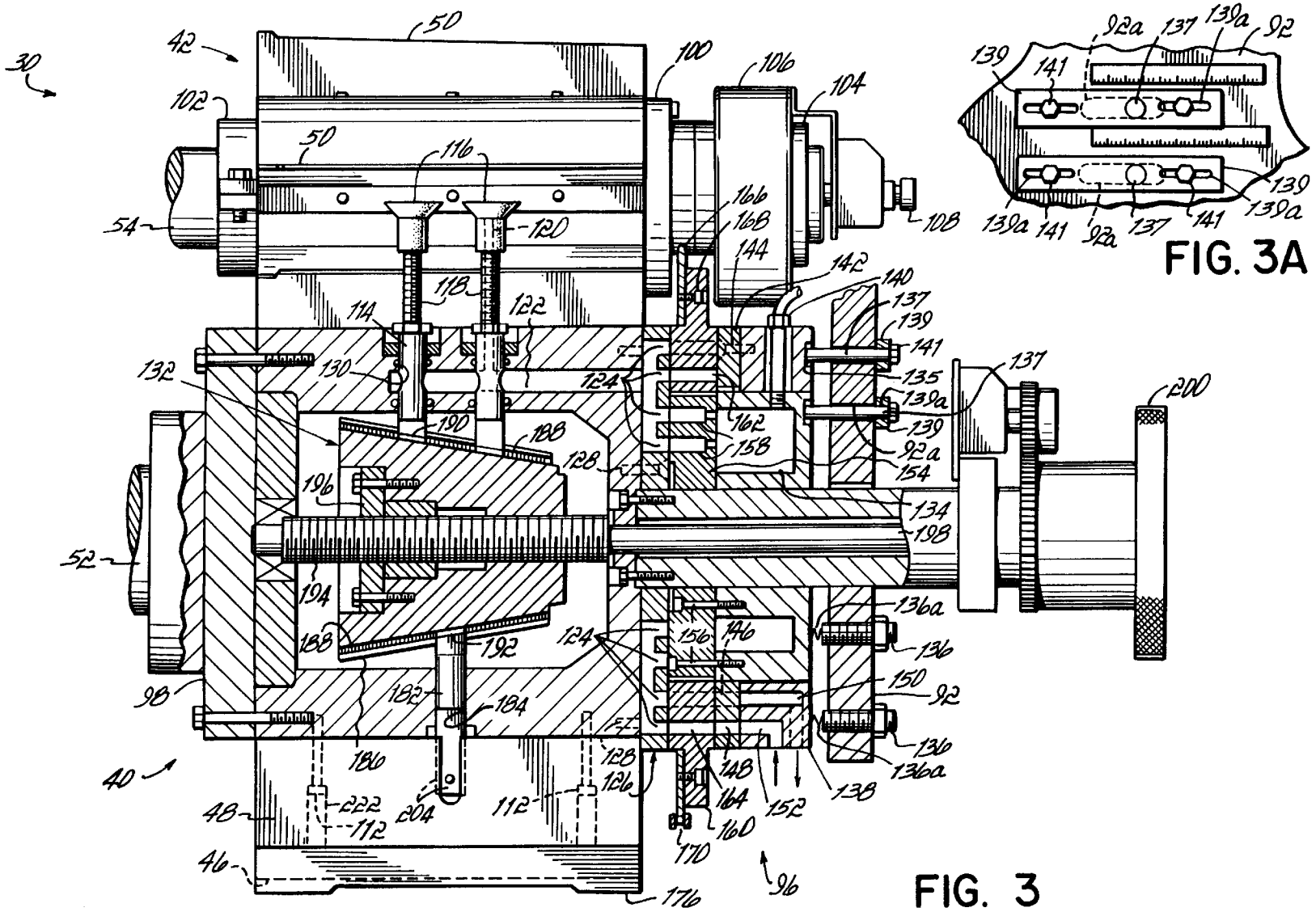
FIG. 3 is a partial cross-sectional view of the present invention taken generally along lines 3—3 of FIG. 1.
FIG. 3A is a front view of the anti-rotation pins for the vacuum reservoir and adjusting ring as will be described.
Figure 4:
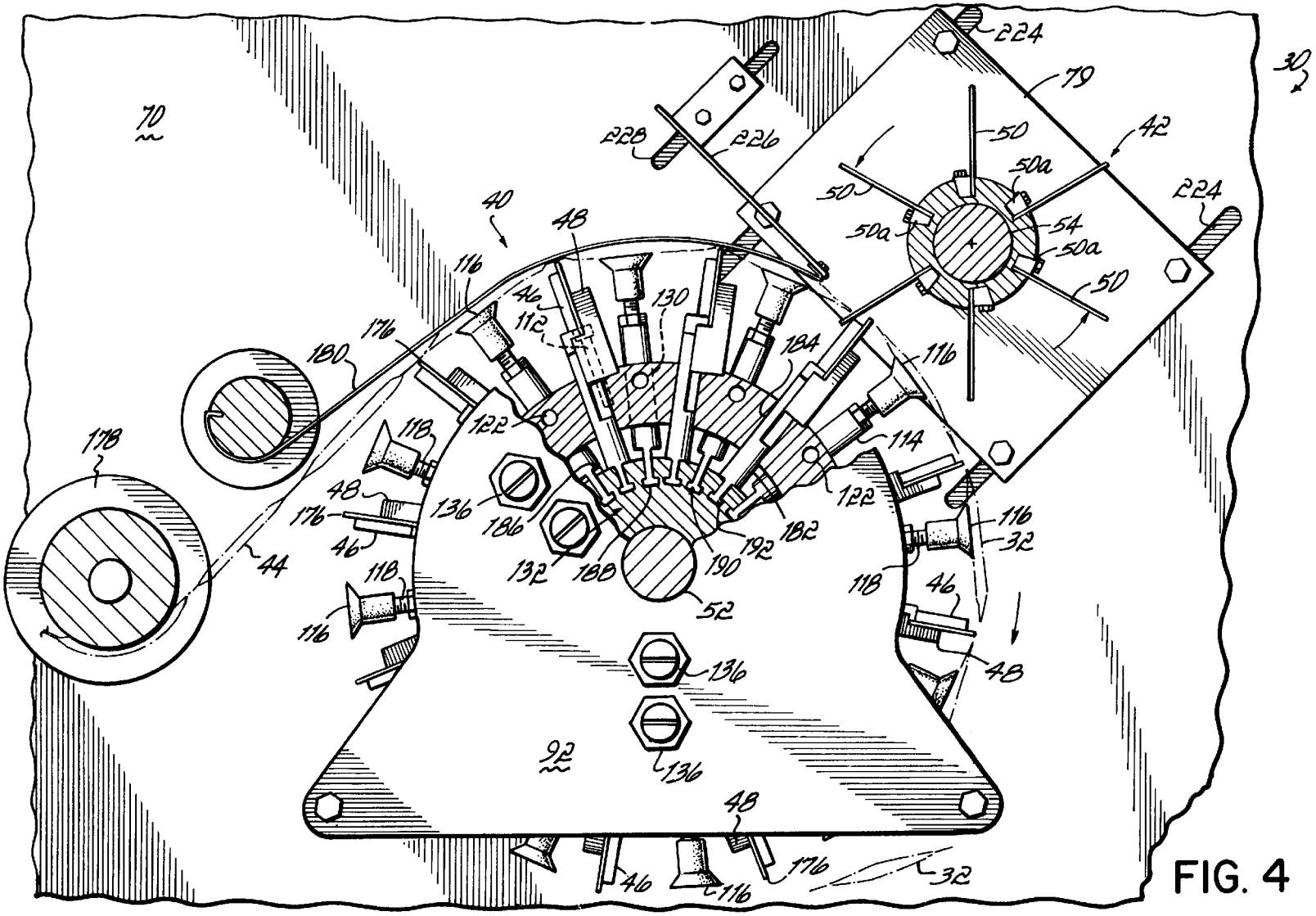
FIG. 4 is a cross-sectional view partially broken away and taken along lines 4—4 of FIG. 2.

The rotary knife apparatus 30 is the focus of the present invention and includes, as shown in FIGS. 2–4, a major knife hub 40 cooperating in shear with a minor knife hub 42 to cut the individual pouches 32 from a web 44 of filled pouches. In accordance with the present invention, the major knife hub 40 includes a plurality of rigid knife blades 46 mounted on radially extending knife blocks 48 attached to the major knife hub 40. The rigid knife blades 46 cooperate with a plurality of tapered flexible knife blades 50 radially extending from the minor knife hub 42 for cutting the web 44 as it passes between the hubs 40 and 42. In one embodiment, the major and minor knife hubs 40 and 42, respectively, are cantilevered on respective major and minor knife hub shafts 52 and 54 as will be described in more detail below.

As shown in FIG. 2, the rotary knife apparatus 30 includes a support frame 56 including pairs of upper and lower support stands 58 and 60, respectively, which are fixedly adjustable relative to each other at joints 62 and secured to a base 63 for positioning the knife apparatus 30 at a desired height above the product transfer conveyor 34. The rotary knife apparatus 30 further includes a cage 64 defined by a rear mounting plate 66 attached to the support frame 56 through vibration mounts 68 (one shown) disposed at each corner of the plate 66 and a front mounting plate 70 attached to the rear mounting plate 66 through braces 72.

The major knife hub shaft 52 is supported in bearing blocks 74 mounted outside the cage 64 and includes a double sprocket 76 fixed to the shaft 52 within the cage 64. The minor knife hub shaft 54 is supported in bearing blocks 78 mounted to adjustment blocks 79 disposed outside the cage 64 and includes a double sprocket 80 fixed to the shaft 54 and co-planar with the double sprocket 76. Preferably, bearing blocks 74 and 78 are preloaded tapered bearings for supporting shafts 52 and 54, respectively.

Figure 5:
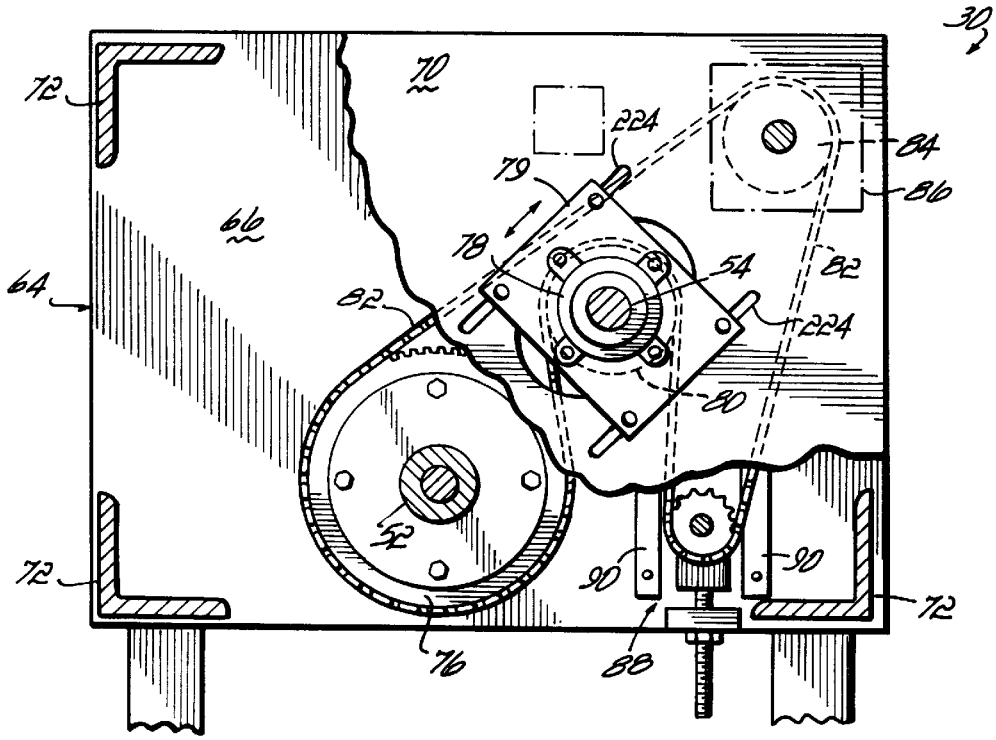
FIG. 5 is a front view of the rotary knife apparatus of the present invention partially broken away.

As shown in FIG. 5, double sprockets 76 and 80 are preferably driven by a multi-strand small pitch (⅜", for example) chain 82 which is itself driven by a driving double sprocket 84 attached to a motor 86 and co-planar with double sprockets 76 and 80. Chain 82 is tensioned around double sprockets 76, 80 and 84 through a tensioner block 88 mounted within the cage 64 and vertically adjustable relative to the rear and front mounting plates 66 and 70, respectively, along rails 90. It will be appreciated that chain 82 could be replaced with a backwrapped timing belt or similar continuous driving member without departing from the present invention.

Referring to FIGS. 2 and 3, and in accordance with the present invention, the rotary knife apparatus 30 further includes a cantilevered support plate 92 attached to the front mounting plate 70 through braces 94. The major and minor knife hubs 40 and 42, respectively, are mounted intermediate the front mounting plate 70 and the support plate 92 on respective major and minor knife hub shafts 52 and 54 which are themselves cantilevered by the cage 64. Mounted intermediate the major knife hub 40 and the support plate 92 is a vacuum and valving system 96 which, while discussed in brief herein, its details are clearly available from copending application Ser. No. 08/338,840 filed on the same date as this application, and entitled "Variable Count Direct Deposit Knife," by P. Dieterlen now U.S Pat. No. 5,575,187 which is incorporated herein by reference.

The major knife hub 40 is fixed to shaft 52 via hub adaptor 98 and minor knife hub 42 is fixed to shaft 54 via hub adaptor 100 (see FIG. 3). A collar 102 and a retaining ring 104 are provided on shaft 54 at either end of the minor knife hub 42 to limit axial movement of the minor knife hub 42 along the shaft 54. The hub adaptor 100 includes an infinite indexer 106 and a screw 108 for adjusting the phasing of the minor knife hub 42 relative to the major knife hub 40. Shoulder screw 108 mounts a calibration indicator. The inner knife phasing is adjusted by loosening locking set screws and rotating mounted sleeve 106. The major knife hub shaft 52 further includes an encoder 110 at a remote end of the shaft from the major knife hub 40 for measuring angular displacement of the major knife hub 40 during operation of the rotary knife apparatus 30.

With reference to FIGS. 3 and 4, the knife blocks 48 of the present invention are circumferentially spaced about the major knife hub 40, twelve being shown, and are mounted to the hub 40 via screws 112. The rigid knife blades 46 are mounted on the knife blocks 48 and cooperate with the radially extending and circumferentially spaced flexible knife blades 50 mounted on the minor hub 42, with six being shown, to cut the pouches 32 from the web 44. These blades are placed in tapered slots across the face of the minor hub 42 and held therein by wedges **50*a* which are screwed into place, frictionally holding the blades therein (FIG. 4**). This particular number of blades is only one form of the apparatus and the number can be varied with different pouch sizes.

The major knife hub 40 further includes a plurality of radially extending and circumferentially spaced suction cup mounts 114, each terminating in a suction cup 116, mounted intermediate the radially extending and circumferentially spaced knife blocks 48. The suction cups 116 are provided for grasping the individual pouches 32 in register with the suction cups 116 during defined segments of rotation of the major knife hub 40 and for expelling the pouches 32 at a predetermined number of angular drop off points.

The suction cups 116 are mounted on threaded suction cup holders 118 which are extensions of the suction cup mounts 114 and include radial ports 120 extending inwardly from the suction cups 116 for communication with positive and negative pressure sources as will be described in more detail below. A plurality of axial inlet ports 122 are provided in the major knife hub 40 which communicate between the radial ports 120 of the suction cups 116 and a plurality of axial ports 124 in a knife hub shoe 126 mounted on the major knife hub 40 via screws 128. The suction cup mounts 114 extend radially through a plurality of circumferentially spaced radial bores 130 in the major knife hub 40 and attach at one respective end to an axially movable cone 132 within the major knife hub 40. In this way, the suction cups 116 are selectively extensible and retractable in respective radial directions as will be described in more detail below.

As shown most clearly in FIG. 3, the vacuum and valving system 96 includes a vacuum reservoir 134 and an adjustable ring 138 disposed circumferentially about reservoir 134. Vacuum is supplied to the vacuum reservoir 134 from a negative pressure source (not shown) via a vacuum tube 140 extending through a clearance hole or slot in adjustable ring 138.

Both the vacuum reservoir 134 and the adjustable ring 138 are spring-loaded toward the major knife hub 40 by means of adjusting screws 136 containing compression springs 136*a*. The vacuum reservoir 134 and the adjustable ring 138 are each acted upon by three such screws and springs spaced equally about circles of appropriate diameter to provide even pressure. Furthermore, the vacuum reservoir 134 and the adjustable ring 138 each contain a radial slot 135, into which anti-rotation pin 137 projects. The pins 137 are attached to blocks 139 mounted over respective slots 92*a* to support plate 92 by screws 141. The pins 137 prevent rotation of the vacuum reservoir 134 and adjustable ring 138 during normal operation of the knife, yet also provide a means by which they may be rotated within limits for purposes of adjusting the timing of the valving system as will be readily appreciated. In this regard, pins 137 are held in the blocks 139. When screws 141 are loosened, these blocks can be moved along slot 92*a* by virtue of slots 139*a* so as to adjust the angular position of the adjusting ring 138 or reservoir 134 respectively.

A ring 142 is fixed to the adjustable ring 138 via screws 144 and includes a pair of arcuate slots 146 and 148 which communicate with respective vacuum and air ports 150 and 152 in the adjustable ring 138 as shown diagrammatically in FIG. 3. Vacuum and air ports 150 and 152, respectively, are coupled to respective negative and positive pressure sources (not shown) whereby arcuate slot 146 provides negative pressure and arcuate slot 148 provides positive pressure to the suction cups 116 to respectively hold and expel the pouches 32 during defined segments of rotation of the major knife hub 40.

A vacuum shoe 154 is mounted on the vacuum reservoir 134 via screws 156 and includes a plurality of staggered arcuate vacuum slots 158 which overlie and communicate with the vacuum reservoir 134. The arcuate vacuum slots 158 communicate with the axial ports 124 in the knife hub shoe 126 along a segment of rotation of the knife hub 40 and are staggered so that if a pouch 32 drops off a particular set of suction cups 116 and causes those cups to lose vacuum, that set of cups 116 remains isolated from adjacent sets of suction cups 116.

A rotating disc valve 160 is provided intermediate the ring 142 and the knife hub shoe 126 and includes a plurality of arcuate slots 162 and apertures 164 which communicate between the arcuate vacuum and air slots 146 and 148 in the ring 142, respectively, and the axial ports 124 in the knife hub shoe 126. The rotating disc valve 160 further includes a metal sprocket 166 fixed about an outer edge of the disc valve 160 via screws 168 whereby the rotating disc valve 160 is driven by a chain 170. The chain 170 is driven by a driving sprocket 172 attached to a servo motor 174 as shown in FIG. 2. In this way, the rotating disc valve 160 dynamically supplies and interrupts negative and positive pressure to the suction cups 116 for selectively dropping the pouches 32 onto the product transfer conveyor 34 beneath the rotary knife apparatus 30.

With further reference to FIGS. 3 and 4, the major knife hub 40 further includes a plurality of radially extending pouch guides 176 which guide the web 44 about the major knife hub 40 as the web 44 feeds off a web guide roller 178. The web 44 is held against the suction cups 116 along a portion of rotation of the major knife hub 40 by an adjustable web holddown 180. The pouch guides 176 are attached to stems 182 attached at one respective end to the axially movable cone 132 and radially extending through radial bores 184 in the major knife hub 40. The pouch guides 176 are thereby selectively extensible and retractable in respective radial directions for purposes to be described in more detail below.

As shown in FIGS. 3 and 4, the cone 132 is centered within the major knife hub 40 and is rotatably mounted therein. The cone 132 has a conical surface 186 having axially extending grooves 188 circumferentially spaced about the conical surface 186. The suction cup mounts 114 and pouch guide stems 182 are slidably attached in the grooves 188 via radial flanges 190 and 192, respectively. A screw 194 is threaded into a nut 196 fixed to the cone 132 so that rotation of the screw 194 causes the cone 132 to move axially back and forth within the major knife hub 40. The screw 194 is fixed to a shaft 198, within the major knife hub shaft 52, and is connected to an external knob 200. Rotation of the knob 200 causes rotation of the screw 194 with respect to the nut 196 which causes axial movement of the cone 132 within the major knife hub 40.

Accordingly, as the cone 132 moves axially back and forth within the major knife hub 40, the suction cups 116 attached to the suction cup mounts 114 and the pouch guides 176 attached to the stems 182 are selectively extensible and retractable in respective radial directions independently of the knife blocks and the knife blades to accommodate varying pouch fills and changeovers to different pitch knife diameters.

Figure 6:
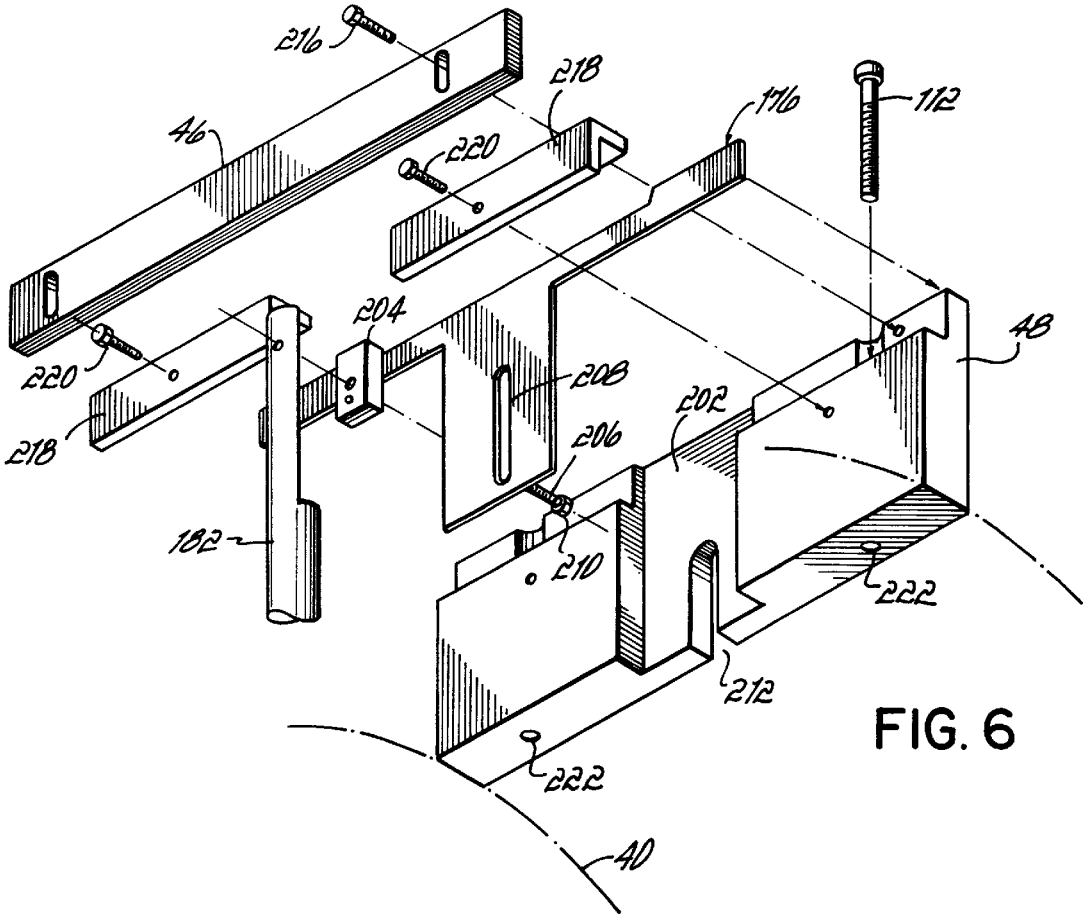
FIG. 6 is an enlarged exploded view of the invention showing the interchangeable knife block, rigid knife blade and adjustable pouch guide.
Figure 7A:
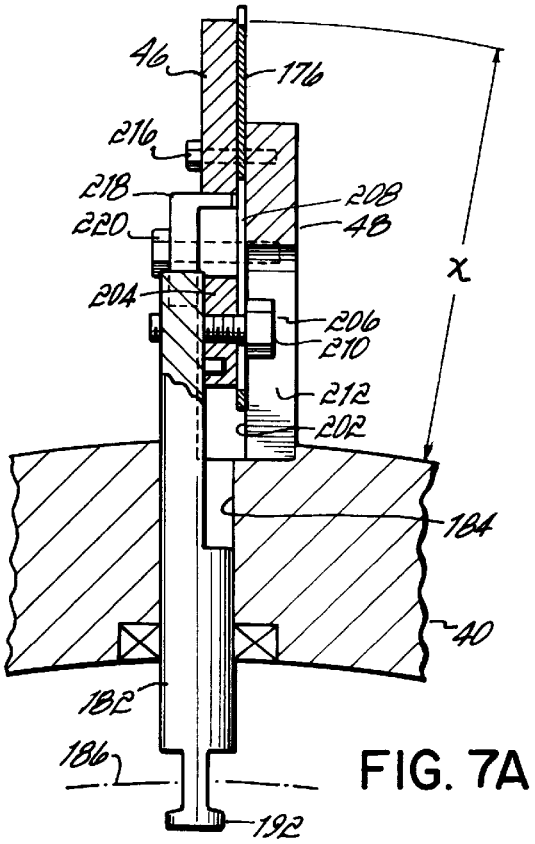
FIG. 7A is an enlarged diagrammatic view of the invention, partially in cross-section, showing a knife block and knife blade having an "X" radial dimension.
Figure 7B:
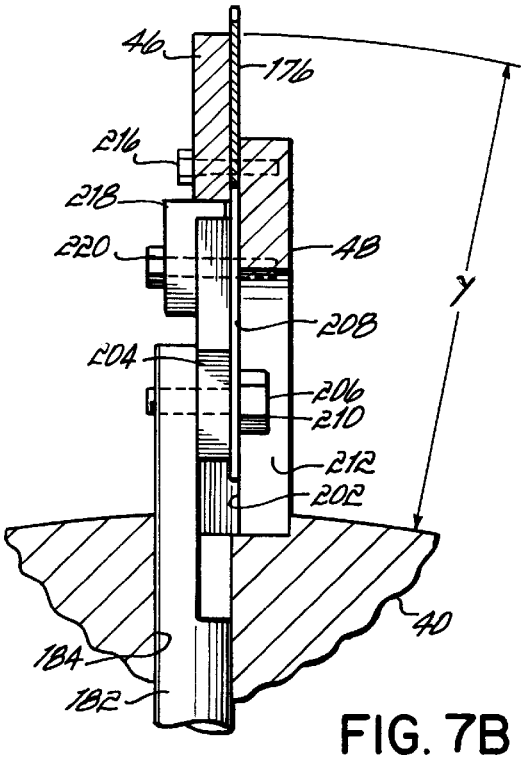
FIG. 7B is an enlarged diagrammatic view of the invention, partially in cross-section, showing a knife block and knife blade having a "Y" radial dimension.

As shown most clearly in FIGS. 6, 7A and 7B, each pouch guide 176 is slidably disposed within a recess 202 in the knife block 48 and mounted to the stem 182 via an intermediate spacer adaptor 204. A screw 206 passes through a slot 208 in the pouch guide 176 and attaches the pouch guide 176 to the stem 182 via the intermediate spacer adaptor 204. The screw 206 includes a screw head 210 which freely travels within a slot 212 in the knife block 48 as will be described in more detail below. It will be appreciated that adapter 204 is tapered to accommodate the appropriate shear angle of the major knife blade. Otherwise, stem 182 must be skimmed or cut with this orientation in mind.

The rigid knife blade 46 is attached to the knife block 48 via screws 216 with at least part of the pouch guide 176 being intermediate the rigid knife blade 46 and the knife block 48. Shims 218 are attached to the knife block 48 intermediate the knife blade 46 and the knife block 48 via screws 220 for purposes to be described in more detail below. The knife block 48 further includes radial bores 222 which receive the screws 112 for mounting the knife block 48 on the major knife hub 40.

In accordance with the present invention, the rotary knife apparatus 30 accommodates relatively small changes in pouch chordal distances via radial adjustment of the pouch guides 176 as described in more detail in U.S. Pat. No. 5,222,422 which is incorporated herein by reference. The pouch guides 176 are selectively extended or retracted in respective radial directions, simultaneously and independently of the knife blocks 48 and rigid knife blades 46, to accommodate pouch chordal changes, for example, from lightly filled pouches to more fully filled pouches, respectively. In this way, with a simple but precise turning of the knob 200, a relatively narrow range of pouch chordal changes can be accommodated without having to change the knife blocks 48.

It will be appreciated that pouch chordal changes beyond the range accommodated by the adjustable pouch guides 176 are typical in current pouch form, fill and seal operations. Thus, in accordance with the present invention, and as shown in FIGS. 7A and 7B, interchangeable knife blocks 48 are provided having varying radial dimensions to accommodate greater varying pouch chordal distances than accommodated by the adjustable pouch guides 176.

In one embodiment, as shown in FIG. 7A, a knife block 48, shims 218 and a rigid knife blade 46 define a radial dimension denoted as "X" to accommodate a pouch chordal distance defined as the chordal distance between adjacent transverse seals 20 of a pouch 32. As pouch chordal distances increase due to varying prefill pouch sizes or variations in product fills of the same pouch size, for example, the chordal distance between adjacent knife blades 46 must be changed accordingly.

This is accomplished in the present invention by replacing the knife blocks 48 as shown in FIG. 7A with knife blocks 48 as shown in FIG. 7B having a greater radial dimension. The knife blocks 48, shims 218 and rigid knife blade 46 define a greater radial dimension denoted as "Y", and thereby accommodate a greater pouch chordal distance between transverse seals 20. It will be understood by those skilled in the art that greater variations of pouch chordal distances can be accomplished by the present invention over the adjustable knife blades or pouch guides of the prior art.

To convert the rotary knife apparatus 30 to a different pitch, the knob 200, cantilevered support plate 92 and web holddown 180 are first removed. Next, the negative and positive pressure sources are disconnected from the vacuum and valving system 96 and the chain 170 is disengaged from the rotating disc valve 160. Once this has been accomplished, the vacuum reservoir 134, adjustable ring 138, fixed ring 142, vacuum shoe 154 and rotating disc valve 160 are separated from the major knife hub 40. The retaining ring 104 is then removed and the minor knife hub 42 is slid off the minor knife hub shaft 54. Lastly, the major knife hub 40 is detached from the hub adaptor 98 and slid off the major knife hub shaft 52. After the major knife hub 40 and minor knife hub 42 have been modified to accommodate the changeover, the rotary knife apparatus 30 is reassembled in a substantially reverse procedure.

As the knife blocks 48 are changed, or the major knife hub 40 is replaced with a knife hub having a different number of rigid knife blades 46 circumferentially spaced about the hub 40, thereby changing the pitch of the major knife hub 40, the minor knife hub 42 must be changed accordingly to maintain proper shearing relationship between the rigid knife blades 46 and the tapered flexible knife blades 50. In one embodiment, the minor knife hub 42 is replaced with another minor knife hub 42 having a different pitch to cooperate in shear with the changed pitch of the major knife hub 40.

To accommodate the changed radial dimensions of the respective major and minor knife hubs 40 and 42 in the rotary knife apparatus 30 as a result of the changeover, the minor knife hub shaft 54 is laterally adjustable relative to the major knife hub shaft 52, on the adjustable blocks 79, along a fixed path defined by slots 224 in the rear and front mounting plates 66 and 70, respectively, as shown in FIGS. 4 and 5. Precise radial adjustments are thereafter made to either the shims 218 or the adjustable pouch guides 176, or both, to maintain proper shearing relationship between respective rigid and flexible knife blades 46 and 48, and to achieve the desired pouch cutoff length. During the changeover, the driving chain 82 is adjusted via the tensioner block 88 to maintain proper tension around the double sprockets 76, 80 and 84. The web holddown 180 is adjusted via an adjustable bracket 226 slidably positionable along a slot 228 in the front mounting plate 70 to maintain the web 44 properly against the suction heads 116.

It will be appreciated that the cantilevered design of the knife shafts 52 and 54 allows the respective major and minor knife hubs 40 and 42 to be readily accessed for changing of the knife blocks 48 and/or the hubs 40 and 42 during a substantial changeover. Furthermore, the laterally adjustable minor knife hub shaft 54, in connection with the chain drive system provided by the chain 82 and motor 86, provide a rotary knife apparatus 30 which will accommodate a substantially wider range of pouch sizes or variations in pouch fills than can be accommodated by present adjustable knife apparatus.

From the above disclosure of the general principles of the present invention and the preceding detailed description of a preferred embodiment, those skilled in the art will readily comprehend the various modifications to which the present invention is susceptible without departing from the scope of the present invention. Therefore, we desire to be limited only by the scope of the following claims and equivalents thereof.

What is claimed is:

1. A rotary knife apparatus for a web of filled pouches, comprising: first and second parallel rotary shafts, each of said first and second rotary shafts having a drive end and a knife hub support end, said first and second rotary shafts each being supported at two spaced locations along said respective shafts proximate said drive end to thereby cantilever said respective knife hub support ends; and first and second knife hubs detachably mounted on said respective knife hub support ends of said rotary shafts, each of said knife hubs having a respective plurality of knife blades radially extending therefrom in respective planes parallel to respective axes of rotation of said first and second rotary shafts for cooperating in shear to cut said filled pouches from said web, said first and second knife hubs being mountable on and removable from said respective knife hub support ends of said first and second rotary shafts to accommodate changeovers to different pitch knife diameters.

2. The rotary knife apparatus of claim 1 wherein said first and second rotary shafts are driven by a continuous flexible driving element.

3. The rotary knife apparatus of claim 2 wherein at least one of said first and second rotary shafts is laterally adjustable relative to said other shaft to accommodate changeovers to different pitch knife diameters.

4. The rotary knife apparatus of claim 1, further comprising:

a plurality of first knife blocks radially extending from and detachably mounted about a circumferential edge of said first knife hub, said first knife blocks having a first radial dimension and further having said knife blades attached thereto, said first knife blocks being removable from said circumferential edge of said first knife hub; and a plurality of second knife blocks having a second radial dimension and further having knife blades attached thereto, said first and second knife blocks being interchangeably mountable about said circumferential edge of said first knife hub to accommodate changeovers to different pitch knife diameters.

5. The rotary knife apparatus of claim 4, said knife blocks further including shims for further adjusting radial displacement of said knife blades.

6. The rotary knife apparatus of claim 4 further including a plurality of radially extending pouch guides, each of said guides being selectively extensible and retractable in respective radial directions independently of said knife blocks and said knife blades to accommodate varying pouch fills and changeovers to different pitch knife diameters.

7. The rotary knife apparatus of claim 4 further including a plurality of radially extending suction cup mounts each terminating in a suction cup, said mounts further being selectively extensible and retractable in respective radial directions independently of said knife blocks and said knife blades to accommodate varying pouch fills and changeovers to different pitch knife diameters.

8. The rotary knife apparatus of claim 4 wherein said first and second knife hub shafts are driven by a continuous flexible driving element.

9. The rotary knife apparatus of claim 8 wherein said second knife hub shaft is laterally moveable relative to said first knife hub shaft along a fixed path whereby said second knife hub shaft is fixedly positionable along said path to accommodate substantial changeovers to different pitch knife diameters.

* * * * *

UNITED STATES PATENT AND TRADEMARK OFFICE

CERTIFICATE OF CORRECTION

PATENT NO. : 6,058,818
DATED : May 9, 2000
INVENTOR(S) : Paul E. Dieterlen

It is certified that error appears in the above-identified patent and that said Letters Patent is hereby corrected as shown below:

Column 1,
Line 15, replace "5,515,787" with -- 5,575,187 --.
Line 17, replace "08/338,470" with -- 08/338,870 --.

Signed and Sealed this

Thirteenth Day of November, 2001

*Attest:*

Nicholas P. Godici

NICHOLAS P. GODICI
*Acting Director of the United States Patent and Trademark Office*

*Attesting Officer*